US009073200B2

(12) United States Patent
Wong

(10) Patent No.: US 9,073,200 B2
(45) Date of Patent: Jul. 7, 2015

(54) PLIANT REMOVEABLE AIRBRUSH GRIP

(75) Inventor: Raymond Wong, Alhambra, CA (US)

(73) Assignee: Tech Stape and Nail, Inc., Monterey Park, CA (US)

( * ) Notice: Subject to any disclaimer, the term of this patent is extended or adjusted under 35 U.S.C. 154(b) by 580 days.

(21) Appl. No.: 13/408,942

(22) Filed: Feb. 29, 2012

(65) Prior Publication Data

US 2013/0219666 A1 Aug. 29, 2013

(51) Int. Cl.
*A45C 13/26* (2006.01)
*B25G 1/10* (2006.01)

(52) U.S. Cl.
CPC ..... *B25G 1/102* (2013.01); *Y10T 29/49826* (2015.01); *Y10T 16/466* (2015.01)

(58) Field of Classification Search
CPC ..... B25G 1/00; B25G 1/10; B25G 1/102; B25G 3/00; B25G 3/04; B25G 3/20; B25G 3/24; B05C 17/0205; B25F 5/02; B25F 5/026; B25F 5/006
USPC ..... 16/441, 414, 904, 421, 422, 430, 431, 16/436, DIG. 12; 401/6, 88, 117; 239/525, 239/526, 530, 346, 353, 355; 173/162.1, 173/162.2; 81/177.1, 177.85, 487, 489; 74/553, 543, 551.9, 551.1, 558
See application file for complete search history.

(56) References Cited

U.S. PATENT DOCUMENTS 445,192 A * 1/1891 Nye et al. ..... 42/71.01
3,825,004 A * 7/1974 Durden, III ..... 604/20
4,079,893 A * 3/1978 Bass ..... 239/346
4,161,289 A 7/1979 Rebold
4,197,611 A * 4/1980 Bell et al. ..... 220/753
4,526,547 A * 7/1985 Rusk ..... 434/166
4,890,355 A * 1/1990 Schulten ..... 16/421
5,366,158 A 11/1994 Robisch et al.
5,421,518 A 6/1995 Robisch et al.

(Continued)

FOREIGN PATENT DOCUMENTS

JP 2002073010 A * 3/2002
TW M250721 1/2004
TW D103729 3/2005

OTHER PUBLICATIONS

GREX, Tritium Series, grexusa.com/grexairbrush/tritium.php5, 2011.

(Continued)

*Primary Examiner* — Chuck Mah
(74) *Attorney, Agent, or Firm* — Canady & Lortz LLP; Bradley K. Lortz

(57) ABSTRACT

A grip for a handheld airbrush is described. The grip comprises pliant material piece having a first cylindrical passage that includes an open axial seam and a second cylindrical passage that is closed, where the second substantially cylindrical passage intersects the first substantially cylindrical open passage opposite the open axial seam. The pliant material piece fills area between ends of the first substantially cylindrical passage and of the second substantially cylindrical passage. The grip is installed with the second substantially cylindrical passage over the airbrush handle or stem and the first cylindrical passage around the cylindrical body with the airbrush toggle extending through the open axial seam. Depressed regions on opposite sides of the pliant material piece aid a user's grip. The grip may be employed with a secondary toggle grip for a toggle button of the airbrush.

13 Claims, 11 Drawing Sheets

(56) References Cited

U.S. PATENT DOCUMENTS

| | | | | |
|---|---|---|---|---|
| 5,492,425 | A * | 2/1996 | Carter et al. | 401/10 |
| 5,779,157 | A * | 7/1998 | Robisch et al. | 239/346 |
| 5,840,122 | A * | 11/1998 | Williams | 118/505 |
| 5,927,602 | A * | 7/1999 | Robisch et al. | 239/1 |
| 6,155,354 | A * | 12/2000 | Pusateri et al. | 173/170 |
| 6,192,774 | B1 * | 2/2001 | Bauer et al. | 74/553 |
| 6,273,626 | B1 | 8/2001 | Yazawa | |
| 6,315,476 | B2 | 11/2001 | Nakagawa | |
| 6,354,517 | B1 | 3/2002 | Wu | |
| 6,399,913 | B1 | 6/2002 | Sammons et al. | |
| 6,439,791 | B1 | 8/2002 | Takeuchi et al. | |
| 6,892,960 | B2 | 5/2005 | Ptak et al. | |
| 7,070,124 | B1 * | 7/2006 | Juo | 239/345 |
| 7,128,656 | B1 * | 10/2006 | Orchel | 473/205 |
| 7,306,390 | B2 * | 12/2007 | Quintero et al. | 401/133 |
| 7,409,791 | B2 | 8/2008 | Moody et al. | |
| 7,572,198 | B2 * | 8/2009 | Bleecker | 473/568 |
| 7,770,262 | B2 | 8/2010 | Schultz et al. | |
| 7,896,191 | B1 * | 3/2011 | Fall et al. | 220/753 |
| 8,602,925 | B1 * | 12/2013 | Rickon, Jr. | 473/568 |
| 2003/0071144 | A1 * | 4/2003 | Naemura | 239/390 |
| 2011/0185617 | A1 * | 8/2011 | Brixius | 42/71.01 |
| 2011/0222952 | A1 * | 9/2011 | Gueret et al. | 401/8 |

OTHER PUBLICATIONS

Diana, "Sneak Peek—Prototype MOJO Parts!," www.mojoairbrush.com/?p=113, Jun. 27, 2011.

Rush, http://www.facebook.com/photo.php?fbid=131655603541279&set=a.105895179450655.3535.102380786468761&type=1&theater, Jul. 8, 2010.

Testors, Aztek A470 Airbrush Instructions, 2007.

Testors, 50654 Airbrush System Instructions, 2003.

* cited by examiner

100
A
A
112B
112A
102
106

100
110A 112A
112B
102
100

100
110A
110B
106

112A
112B
102
100

PLIANT REMOVEABLE AIRBRUSH GRIP

BACKGROUND OF THE INVENTION

1. Field of the Invention

This invention relates to grips for hand tools. Particularly, this invention relates grips for handheld airbrushes.

2. Description of the Related Art

Airbrushes have been employed for many years in the application of atomized media, such as paint, to surfaces. A typical airbrush operates by passing a stream of compressed gas (e.g. air) through a venturi which generates a localized zone of reduced pressure or suction. This suction is used to draw a liquid (e.g. paint) from a connected reservoir. The velocity of the compressed gas stream atomizes the liquid into very tiny droplets as it is driven past a metering device where it is directed to a surface thereafter. The amount of delivered liquid is typically controlled via a trigger that controls the compressed gas flow. Liquid flow may also be metered by a needle valve. In a "single action" airbrush, the compressed gas flow alone is controlled by the trigger while the liquid flow is controlled by a separate knob or dial.

Airbrushes can range in size and design depending upon their application. One very common type of airbrush is handheld and referred to as a "double action" airbrush because compressed gas flow and liquid (paint) delivery are independently controlled. Both the compressed gas flow and liquid (paint) delivery are commonly controlled through a single bifunctional toggle, e.g. such that the toggle is depressed to allow compressed gas flow and drawn back to deliver liquid. A typical double action airbrush comprises a cylindrical body the size of a writing stylus. A cylindrical stem (or handle) engages the cylindrical body perpendicularly at its middle on the lower side. The cylindrical stem may also serve as the port for a compressed gas supply line. Alternately, the compressed gas supply line port may be disposed at the back or front end of the cylindrical body. The control toggle extends from the top side of the cylindrical body opposite the cylindrical stem. The liquid reservoir is be disposed towards the delivery (nozzle) end of the cylindrical body. A gravity feed employs the liquid reservoir disposed on the top (or possibly side) of the cylindrical body, whereas a siphon feed employs the liquid reservoir on the bottom (or possibly side) of the cylindrical body. The liquid and compressed gas are mixed internally before exiting the airbrush at the nozzle end. In other airbrush designs, the liquid and compressed gas may also be mixed externally. As used herein, the term "airbrush", refers to a handheld airbrush (which may employ single or double action) as known in the art. Such airbrushes are typically employed by artists to create original works. Airbrush images have often been applied to custom automobiles and clothing (notably t-shirts), for example. In addition, such airbrushes have been commonly employed to retouch photographs or apply makeup.

The double action airbrush is held in one hand in a grip similar to a pencil grip. Due to the perpendicular extension of the compressed gas supply line and location of the toggle, the user typically rests the rear end of the cylindrical body between the thumb and index finger wrapping the thumb around the member while positioning the index finger on the toggle. The remaining fingers may be wrapped around the cylindrical stem. It is important that the user's grip is comfortable and secure, particularly where the airbrush is employed for long periods of time. Although some prior art airbrushes have implemented rudimentary grips, typically no accommodation is made to improve these aspects of the airbrush. In most cases, the user simply grasps the the cylindrical stem (which may included the bare compressed gas supply line fittings) and cylindrical body. Airbrushes held in this way may inadvertently slip during use resulting in errors and rework. In addition, the rough fittings (e.g. knurled nuts) of the gas supply line may irritate the user's hand over time.

In view of the foregoing, there is a need in the art for apparatuses and methods enabling the manipulation and operation of airbrushes. In addition, there is a need for such apparatuses and methods to allow confortable and precise control of airbrushes over long periods. There is also a need for such apparatuses and methods that can be easily retrofitted to an existing airbrush design. There is further a need for such systems and apparatuses to be replaceable and variable to accommodate different hand sizes and/or grips. These and other needs are met by the present invention as detailed hereafter.

SUMMARY OF THE INVENTION

A grip for a handheld airbrush is described. The grip comprises pliant material piece having a first cylindrical passage that includes an open axial seam and a second cylindrical passage that is closed, where the second substantially cylindrical passage intersects the first substantially cylindrical open passage opposite the open axial seam. The pliant material piece fills areas between ends of the first substantially cylindrical passage and of the second substantially cylindrical passage. The grip is installed with the second substantially cylindrical passage over the airbrush handle or stem and the first cylindrical passage around the cylindrical body with the airbrush toggle extending through the open axial seam. Depressed regions on opposite sides of the pliant material piece aid a user's grip. The grip may be employed with a secondary toggle grip for a toggle button of the airbrush.

A typical body grip embodiment of the invention comprises a pliant material piece having a substantially cylindrical open passage therethrough such that the substantially cylindrical open passage includes an open axial seam, and a substantially cylindrical closed passage in the pliant material piece, where the substantially cylindrical closed passage intersects the substantially cylindrical open passage opposite the open axial seam. The pliant material piece fills areas between ends of the substantially cylindrical open passage and of the substantially cylindrical closed passage. Typically, the pliant material piece may comprise silicone rubber. The pliant material piece may further comprise depressed regions on opposing exterior surfaces. In addition, the substantially cylindrical open passage may comprise more than a semicylindrical surface so that the open passage is over the widest point of the cylindrical body of an airbrush when installed. In use, the pliant material piece may be applied to an airbrush such that the substantially cylindrical closed passage surrounds a stem of the airbrush and the substantially cylindrical open passage is around a cylindrical body of the airbrush.

In a further embodiments, a second pliant material piece may be used having a substantially disk shape, the substantially disk shape including a rough texture on a top side and a pocket on a bottom side. The second pliant material piece is applied to a toggle button of the airbrush such that the toggle button is enclosed by the pocket. Similarly, the second pliant material piece may comprise silicone rubber. The rough texture of the second pliant material piece may comprise a series of ridges.

In a similar manner, a typical method embodiment of applying a grip to an airbrush comprises inserting a stem of the airbrush into a substantially cylindrical closed passage in a pliant material piece, where the substantially cylindrical closed passage intersects a substantially cylindrical open passage opposite an open axial seam of the substantially cylindrical open passage and the pliant material piece fills areas between ends of the substantially cylindrical open passage and of the substantially cylindrical closed passage, drawing the pliant material piece onto the stem as the substantially cylindrical open passage is pulled over a cylindrical body of the airbrush at the open seam, and seating the open seam of the substantially cylindrical open passage around cylindrical body. The method embodiment may be further modified consistent with the apparatus embodiments described herein.

A typical toggle grip embodiment comprises a pliant material piece having a substantially disk shape, the substantially disk shape including a rough texture on a top side and a pocket on a bottom side. The second pliant material piece is applied to a toggle button of the airbrush such that the toggle button is enclosed by the pocket. The toggle grip embodiment may be further modified consistent with other embodiments of the invention described herein.

BRIEF DESCRIPTION OF THE DRAWINGS

Referring now to the drawings in which like reference numbers represent corresponding parts throughout.

DETAILED DESCRIPTION OF THE PREFERRED EMBODIMENT

1. Overview

Figure 1A:
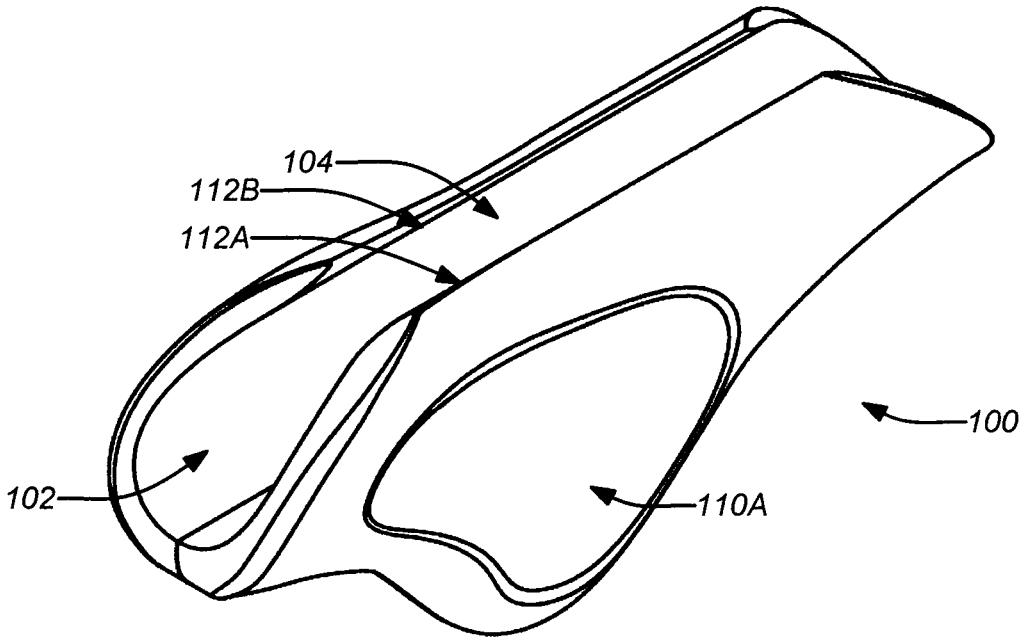
FIGS. 1A-1G illustrate top and bottom isometric views and side, top, bottom, front and rear views, respectively, of an exemplary pliant removable airbrush body grip embodiment of the invention.

As previously mentioned, embodiments of the invention are directed to a handheld airbrush body grip. The airbrush body grip comprises a unitary design and is produced from a pliant material, such as silicone and/or rubber. The grip is configured having a first cylindrical passage that includes an open axial seam and a second cylindrical passage that is closed where the closed substantially cylindrical passage intersects the open substantially cylindrical opposite the open axial seam. Typically, the passages intersect perpendicularly, although embodiments of the invention can be implemented with almost any intersection angle between the passages as necessary to fit a particular airbrush configuration. The pliant material piece fills areas between ends of the passages. Depressed regions on opposite sides of the pliant material piece aid a user's grip. The depressed regions may comprise various sizes and shapes and include different surface textures.

The airbrush body grip is installed on an airbrush with the closed passage over the airbrush handle or stem and the open passage around the cylindrical body with the airbrush toggle extending through the open axial seam. The airbrush body grip may be employed with a toggle grip for a toggle button of the airbrush.

2. Pliant Removable Airbrush Body and Toggle Grips

FIGS. 1A-1G illustrate top and bottom isometric views and side, top, bottom, front and rear views, respectively, of an exemplary pliant removable airbrush body grip 100 embodiment of the invention. The body grip 100 is a unitary pliant material piece which may be molded from silicone rubber or other known suitable materials such as synthetic rubber, solvent proof viton, some plastics, PVC, PE, or PP. Different pliant materials may have different softness/firmness to accommodate different artist preferences. The body grip 100 includes a first cylindrical open passage 102 which passes through its entire longitudinal length. The open passage 102 includes an open axial seam 104 along the top side of its length. Typically, the open passage 102 comprises more than a semicylindrical surface such that the edges 112A, 112B of the axial seam 104 ride over the widest point of the cylindrical body of an airbrush when installed. In some cases, the axial seam 104 may be simply a split in the pliant material with a slightly open area for the toggle (e.g. in a circular, oval, elliptical, or triangular). In this case, the open passage 102 wraps completely around the main body of the airbrush when installed. An important feature is provided by the basic configuration of the body grip 100 including the open axial seam 104 which allows for easy installation of the grip 100 onto an existing airbrush without requiring any significant disassembly of the airbrush. Thus, body grip embodiments of the invention may be readily installed onto existing airbrushes and easily replaced if they become worn or broken. In addition, grips have different exterior shapes (e.g. to accommodate different hand sizes and/or grip types) may be selected for almost any airbrush to readily facilitate user customization.

The grip 100 also includes a cylindrical closed passage 106 which intersects the open passage 102 opposite the open axial seam 104. Typically, the passages 102, 106 intersect perpendicularly. However, the intersection angle of passages 102, 106 may vary depending upon the applicable airbrush. In addition, use of a proper pliant material alone can accommodate a reasonable degree angular variation between the airbrush handle and body; the passages 102, 106 may intersect perpendicularly but be fitted onto an airbrush where the handle and body do not intersect perpendicularly. Moreover, the use of a suitable pliant material (along with the configuration including the open axial seam 104 allowing easy installation and removal) allows a particular grip design to accommodate a variety of different airbrushes. The pliant material will stretch in places to securely hold to most similar airbrush shapes across a range of airbrush sizes and features. Thus, a user may fit the same grip to different airbrushes allowing a consistent feel across different tools. In addition, due to the use of a pliant material, some deviation from a perfect match between the exterior shape of the airbrush and the interior shape of the grip 100 is tolerable; some stretching of the grip 100 over the airbrush may be preferable for a secure fit.

Note that the passages 102, 106 in the grip 100 may be described as "substantially cylindrical" herein because they are configured to at least partially encircle parts of an airbrush. However, those skilled in the art will appreciate that the passages shapes may vary to a large degree without departing from the scope of the invention. For example, oval or other organic shape, as well as polygon or other geometric shapes may also be employed in embodiments of the invention.

Figure 1B:
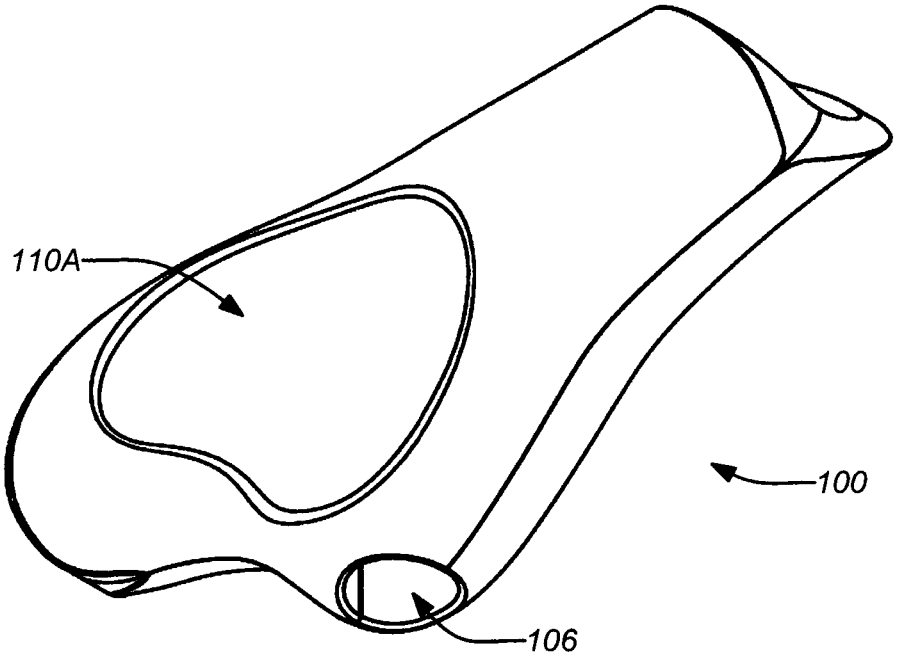
Figures 1C, 1D, 1E, 1F, 1G:
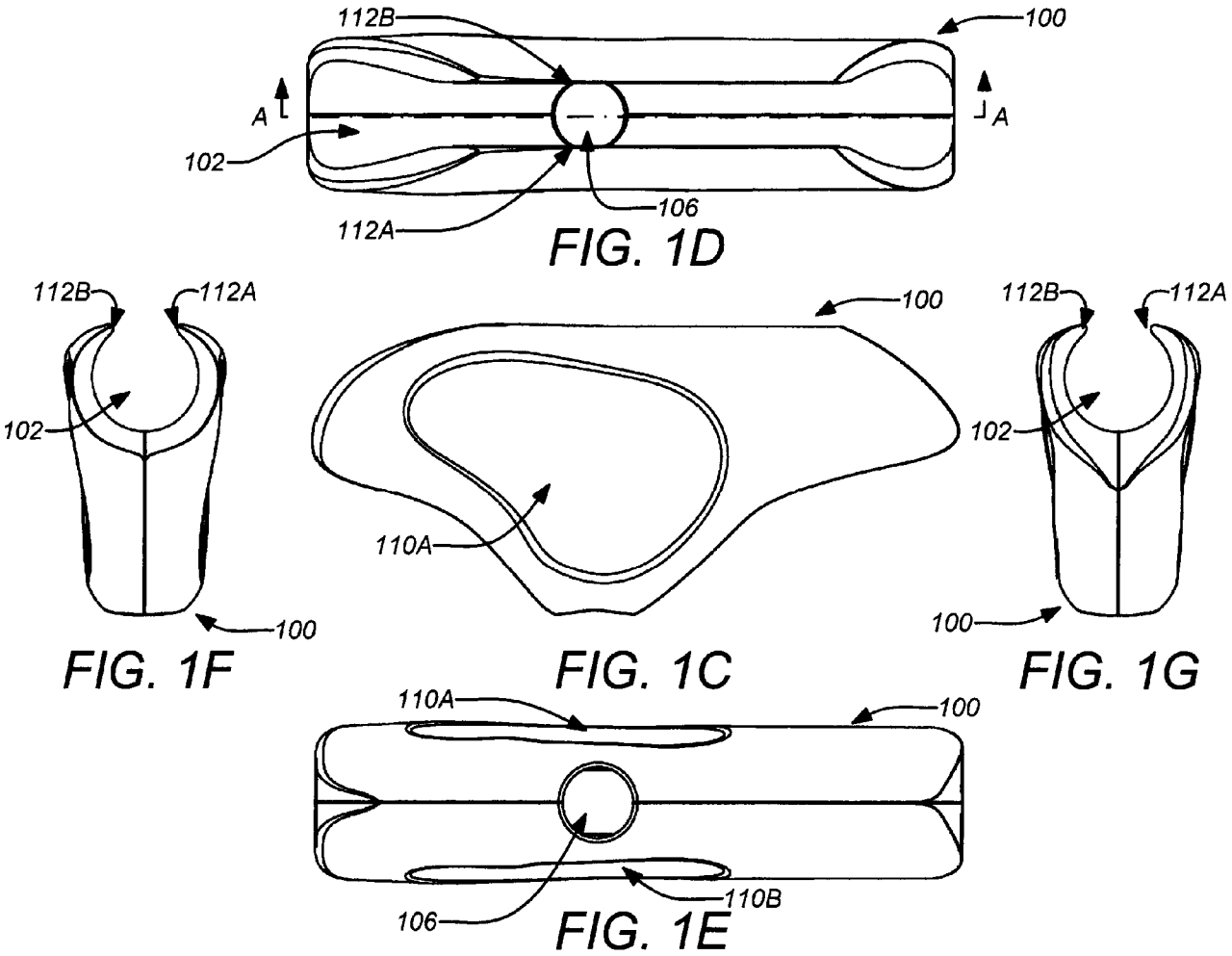
Figure 2A:
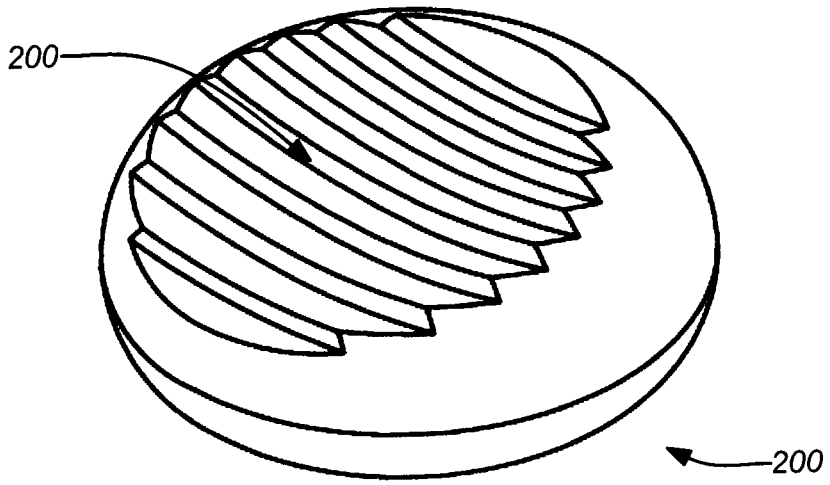
FIGS. 2A-2G illustrate top and bottom isometric views and side, top, bottom, front and rear views, respectively, of an exemplary pliant removable airbrush toggle grip embodiment of the invention.
Figure 2B:
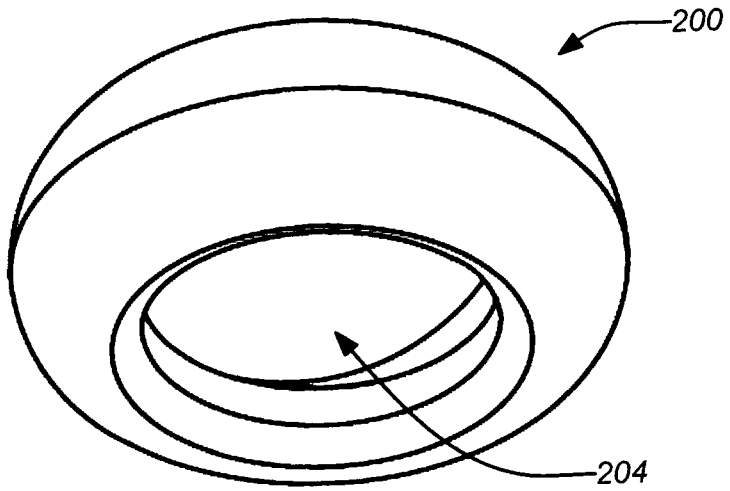
Figures 2C, 2D, 2E, 2F, 2G:
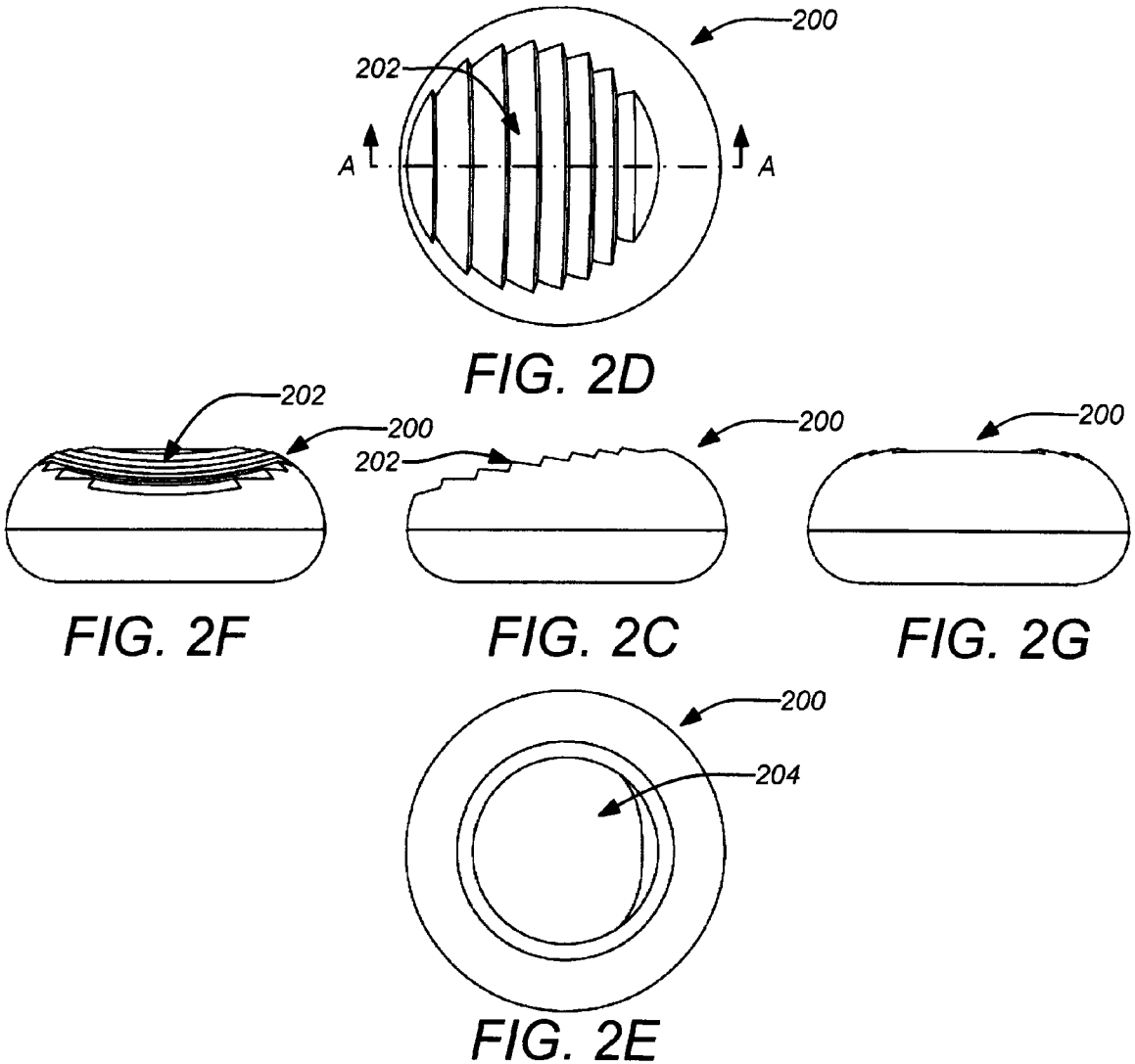
Figure 3A:
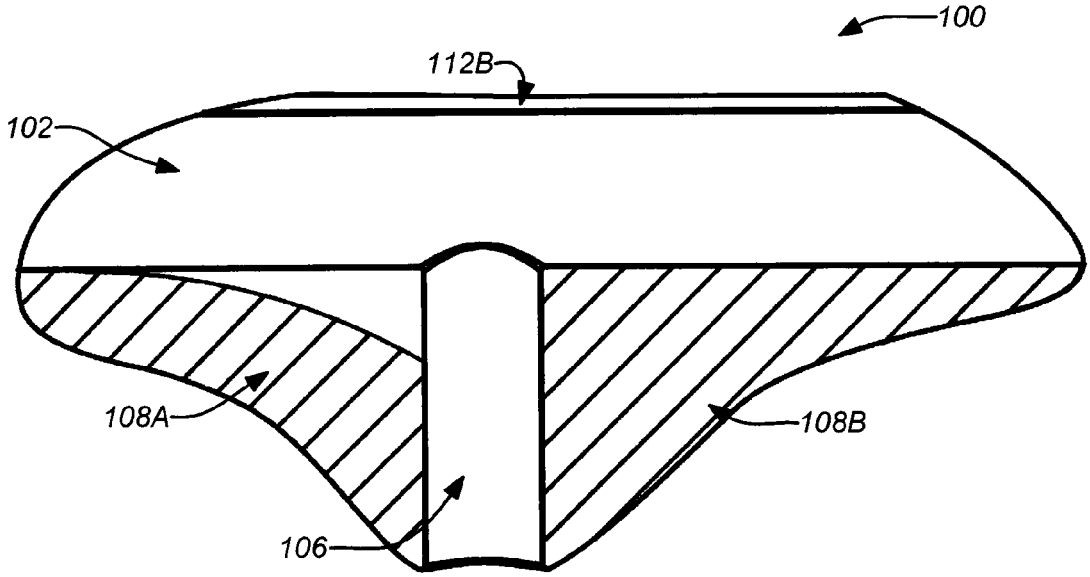
FIG. 3A illustrates section A-A view indicated in FIG. 1D of the exemplary pliant removable airbrush body grip embodiment of the invention shown in FIGS. 1A-1G.

The pliant material of the grip 100 fills areas (forward region 108A and aft region 108B) between ends of the cylindrical open passage 102 and of the cylindrical closed passage 106 in an organic shape to allow a comfortable secure grip by the use when installed on an airbrush. FIG. 3A illustrates section A-A view indicated in FIG. 1D of the exemplary pliant removable airbrush body grip embodiment of the invention shown in FIGS. 1A-1G. The grip 100 also includes depressed regions 110A, 110B on opposing exterior surfaces. The depressed regions 110A, 110B provide a secure comfortable and repeatable grip for the user by allowing them to locate their fingers in the regions 110A, 110B. See FIGS. 6A and 6B. For example, the depressed regions 110A, 110B can be "kidney bean" shape having a front lobe smaller than a rear lobe as shown in FIGS. 1A-1C. In further embodiments, the depressed regions may comprise various sizes and shapes and include different surface textures. For example, a knurled or bubbled texture may be used to improve grip.

Figure 3B:
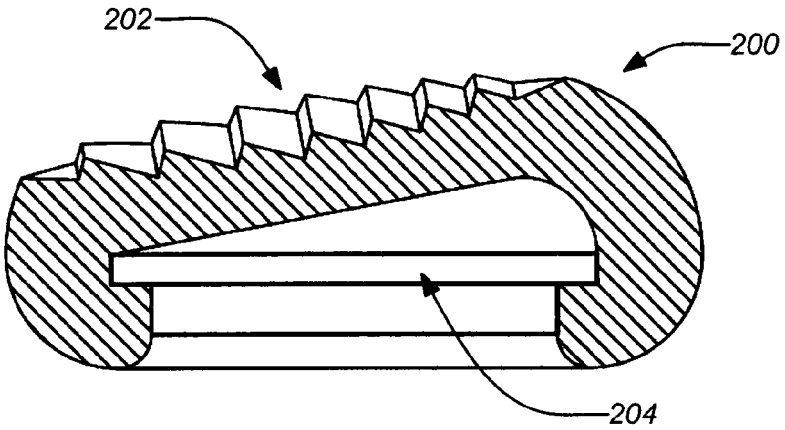
FIG. 3B illustrates section A-A view indicated in FIG. 2D of the exemplary pliant removable airbrush toggle grip embodiment of the invention shown in FIGS. 2A-2G.
Figure 4A:
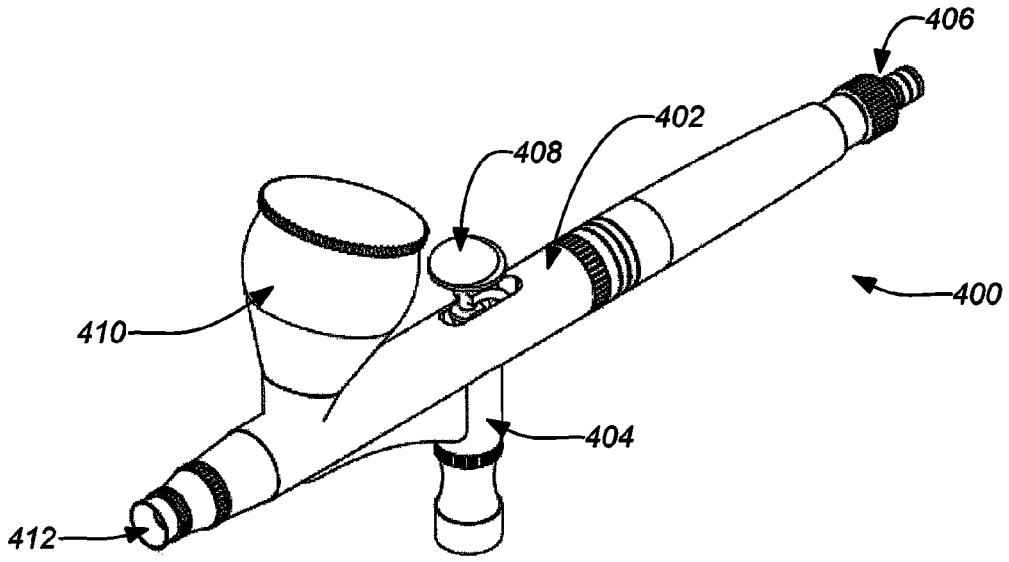
FIGS. 4A-4G illustrate top and bottom isometric views and side, top, bottom, front and rear views, respectively, of an exemplary airbrush.
Figure 4B:
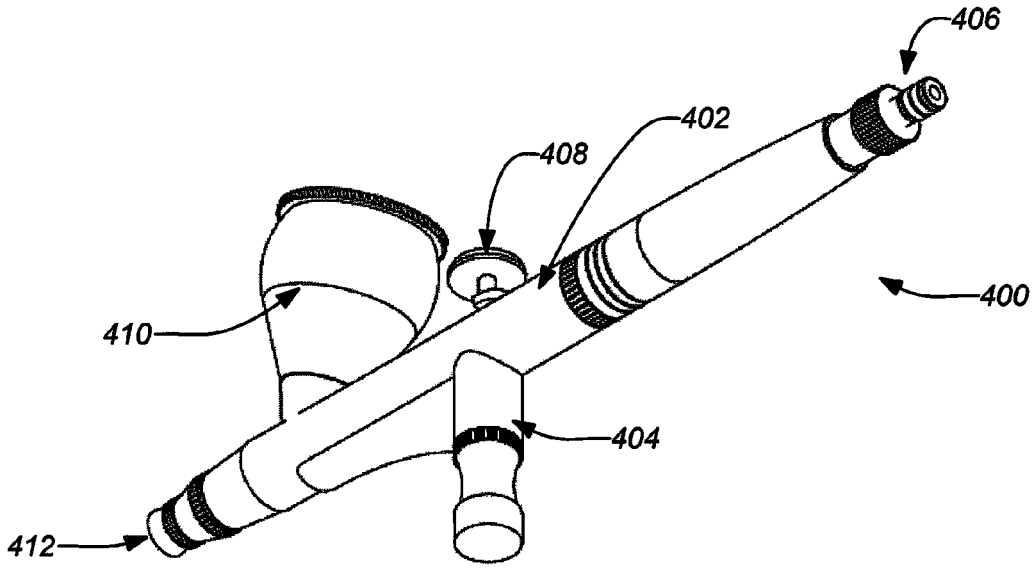
Figure 4D:
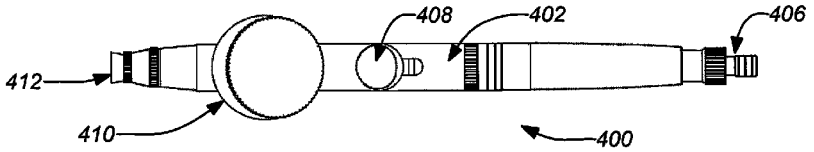
Figure 4F:
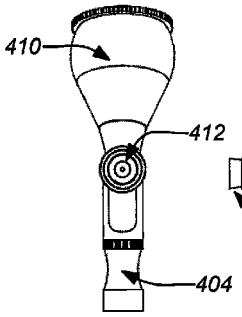
Figure 4C:
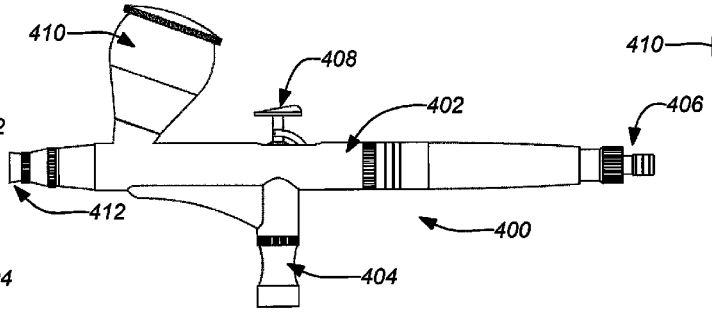
Figure 4G:
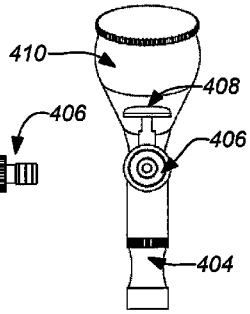
Figure 4E:
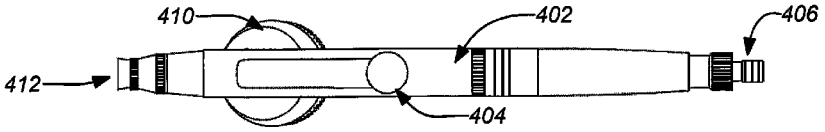
Figure 5A:
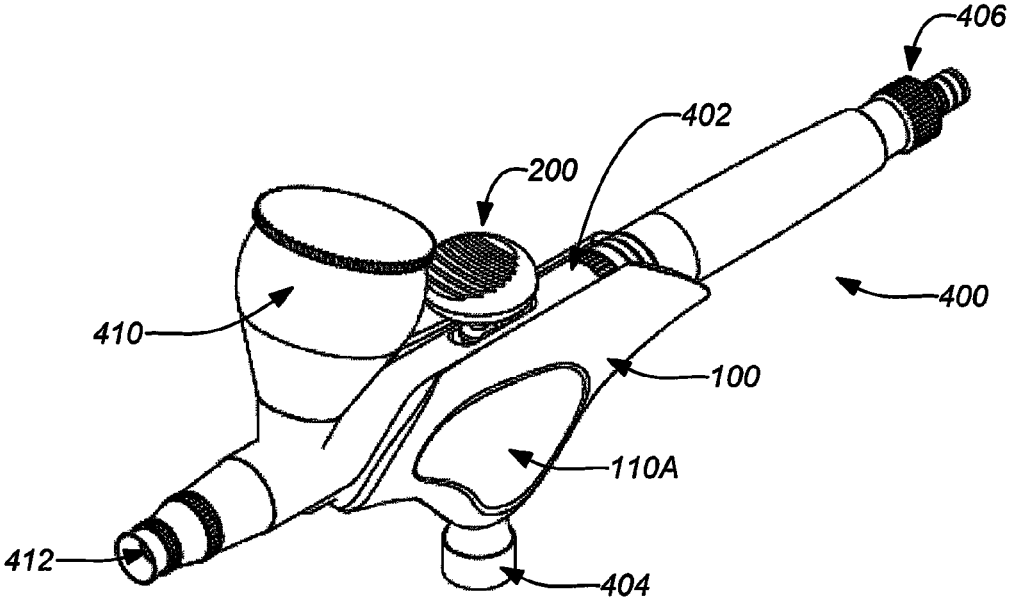
FIGS. 5A-5G illustrate top and bottom isometric views and side, top, bottom, front and rear views, respectively, of an exemplary pliant removable airbrush body and toggle grip embodiments of the invention installed on the exemplary airbrush of FIGS. 4A-4G.
Figure 5B:
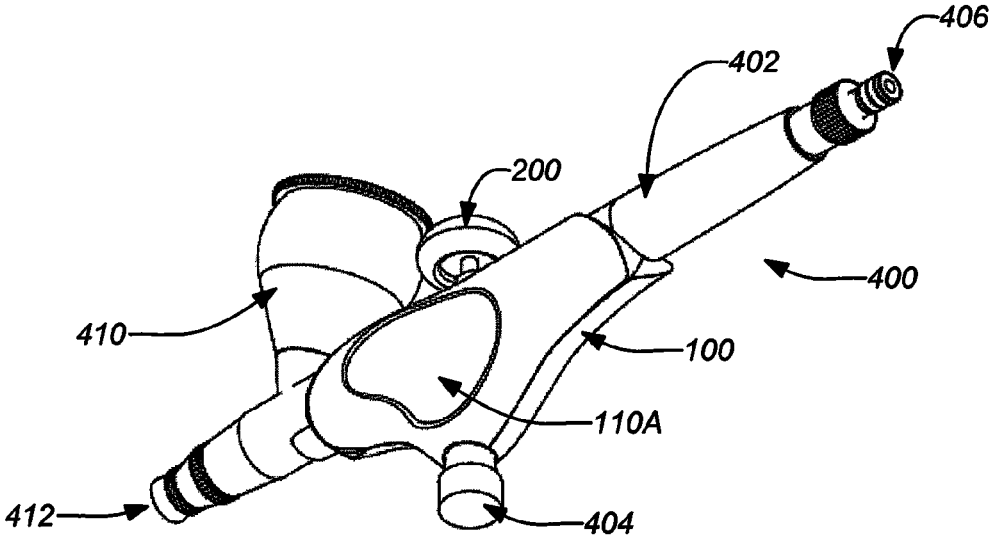
Figure 5D:
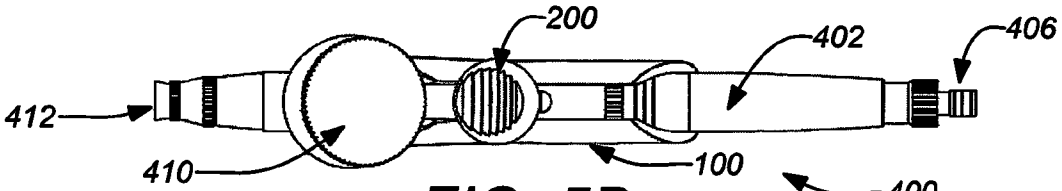
Figure 5C:
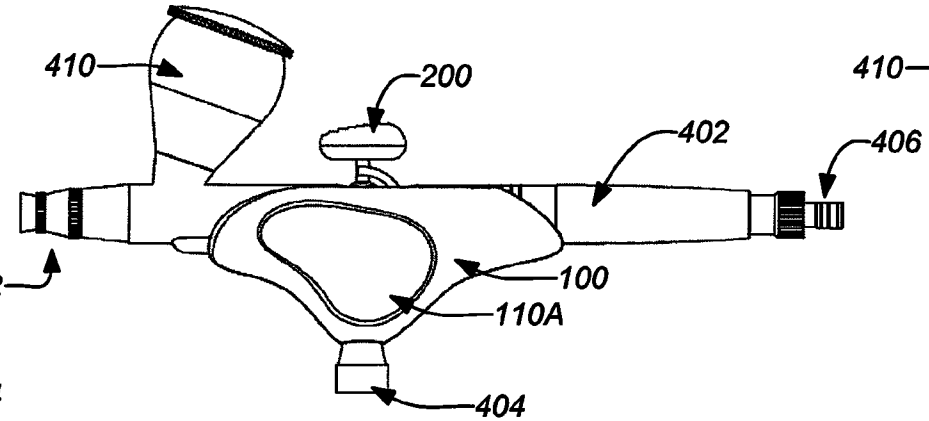
Figure 5E:
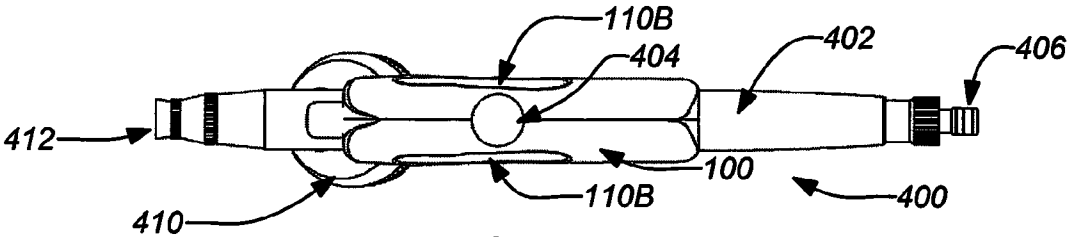
Figure 5G:
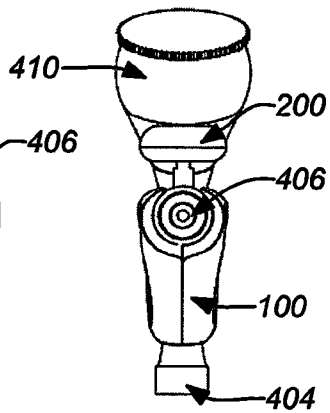
Figure 5F:
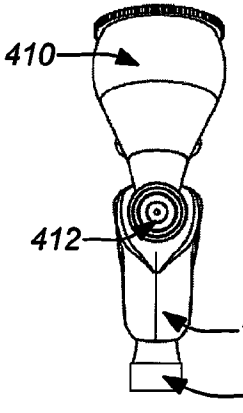

FIGS. 2A-2G illustrate top and bottom isometric views and side, top, bottom, front and rear views, respectively, of an exemplary pliant removable airbrush toggle grip 200 embodiment of the invention. The toggle grip 200 is a separate pliant material piece (which may be produced from any of the materials, e.g. silicone rubber, suitable for the body grip 100 previously described). The toggle grip 200 comprises a substantially disk shape that including a rough texture 202 on a top side and a pocket 204 on a bottom side. The pocket 204 comprises a smaller opening than its deeper interior space. The top surface may be formed into any rough texture suitable for providing grip against a user's finger. In one example, the rough texture 202 may comprise a series of ridges. The shape of the pocket 204 may be matched to accommodate the particular toggle button of the intended airbrush with some stretch of the grip 200 designed in to ensure a tight fit that does not slip on the button. Similarly, due to the use of a pliant material, some deviation from a perfect match between the shape of the toggle button and the pocket 204 is tolerable. Accordingly, a given toggle grip 200 may work with many different airbrushes (similar to the body grip 100 described above). In the example toggle grip 200, the pocket 204 has an asymmetric shape, but the shape could alternately be symmetric and with or without other indexing features to secure it to the toggle button. The pocket 204 of the toggle grip 200 is installed over the toggle button of an airbrush. The installation of the toggle grip 200 may also be varied in rotational position depending upon user preference. FIG. 3B illustrates section A-A view indicated in FIG. 2D of the exemplary pliant removable airbrush toggle grip embodiment of the invention shown in FIGS. 2A-2G.

3. Application of Pliant Airbrush Body and Toggle Grips

FIGS. 4A-4G illustrate top and bottom isometric views and side, top, bottom, front and rear views, respectively, of an exemplary airbrush 400 operable with grips according to embodiments of the invention, e.g. as shown in FIGS. 1A to 3B. The airbrush 400 comprises a cylindrical body 402 the size of a writing stylus. A cylindrical stem 404 (or handle) engages the cylindrical body perpendicularly at its middle on the lower side. As shown in the figures, the compressed gas supply line port is located at the back end 406 of the cylindrical body 402. As previously mentioned, in some cases the cylindrical stem 404 may alternately serve as the port for a compressed gas supply line. The control toggle 408 extends from the top side of the cylindrical body 402 opposite the cylindrical stem 404. (It should be noted that the body grip will accommodate a toggle located in any position along the top side of the cylindrical body 402 due to the open seam.) The liquid reservior 410 is be disposed towards the delivery (nozzle) end 412 of the cylindrical body 402. As shown, a gravity feed is employed such that the liquid resevoir 410 is disposed on the top of the cylindrical body 402. The liquid and compressed gas are mixed internally before exiting the airbrush 400 at the nozzle end 412 as with any conventional handheld airbrush.

Those skilled in the art will appreciate that embodiments of the invention may be employed with a siphon feed as well or with the reservoir attached at the sides of the cylindrical body 402. Moreover, thosed skilled in the art will further appreciate embodiments of the invention are operable with may variant airbrush configurations and having other features than the example shown; embodiments of the invention is not limited to any particular airbrush. Particularly, the internal mechanical detals are immaterial to the use of the grip embodiments of the invention described herein.

FIGS. 5A-5G illustrate top and bottom isometric views and side, top, bottom, front and rear views, respectively, of an exemplary pliant removable airbrush body and toggle grip embodiments of the invention (as shown shown in FIGS. 1A to 3B) installed on the exemplary airbrush of FIGS. 4A-4G. The pliant material piece of the body grip 100 is applied to the airbrush 400 such that the substantially cylindrical closed passage 106 surrounds the stem 404 of the airbrush 400 and the substantially cylindrical open passage 102 is around a cylindrical body 402 of the airbrush 400. The pocket 204 of the toggle grip 200 is installed over the toggle button 408 of the airbrush 400.

Figure 6:
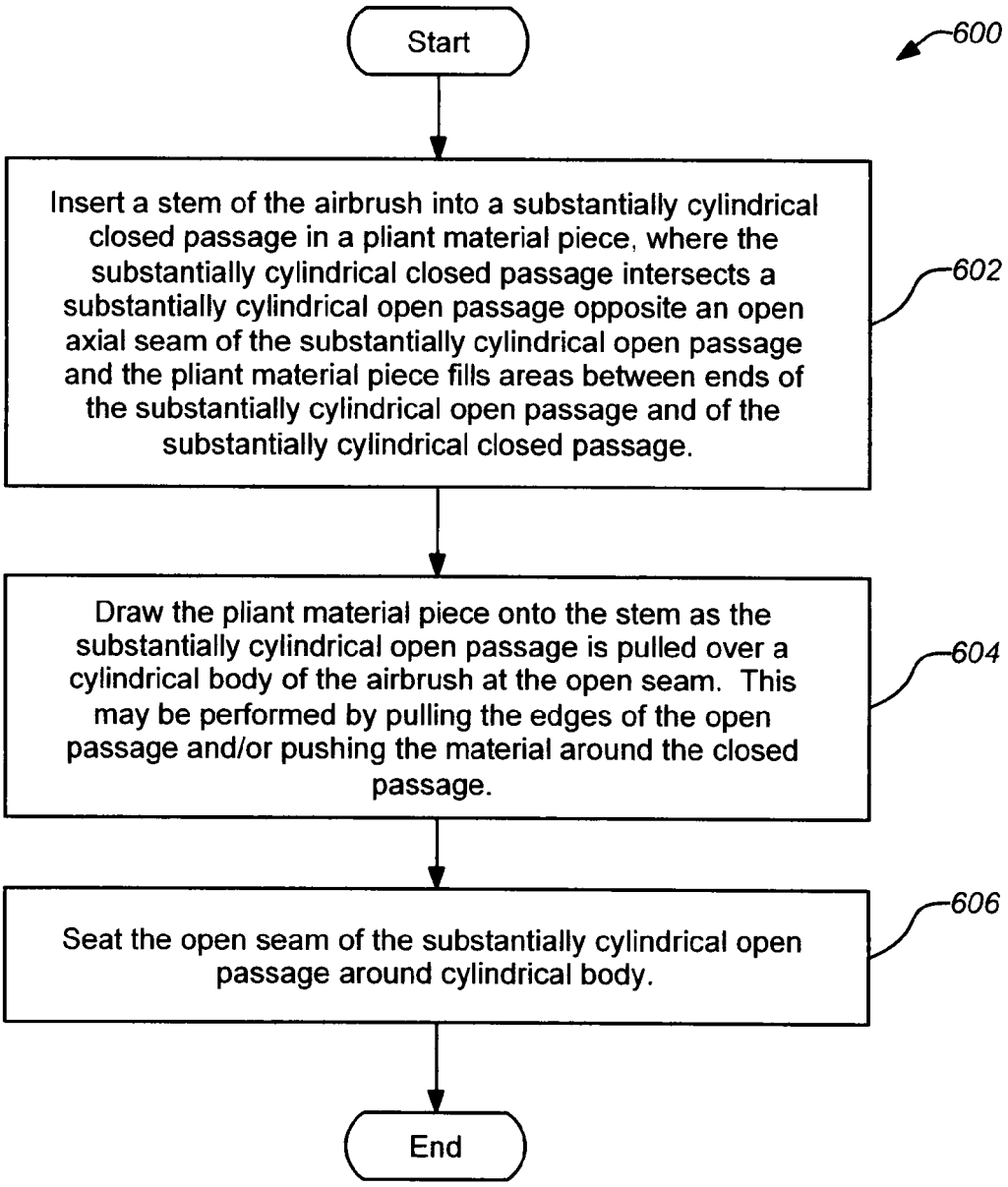
FIG. 6 is a flowchart of an exemplary method 700 of applying a grip to an airbrush.

FIG. 6 is a flowchart of an exemplary method 600 of applying the body grip 100 onto an airbrush. The method 600 begins with an operation 602 of inserting a stem of the airbrush into a substantially cylindrical closed passage in a pliant material piece, where the substantially cylindrical closed passage intersects a substantially cylindrical open passage opposite an open axial seam of the substantially cylindrical open passage and the pliant material piece fills areas between ends of the substantially cylindrical open passage and of the substantially cylindrical closed passage. Next, in operation 604, the pliant material piece is drawn onto the stem as the substantially cylindrical open passage is pulled over a cylindrical body of the airbrush at the open seam. This may be performed by pulling the edges of the open passage and/or pushing the material around the closed passage. In operation 606, the open seam of the substantially cylindrical open passage is seated around cylindrical body. As previously mentioned, the body grip 100 is preferable sized to be at least slightly stretched over the body of the airbrush. The tight fit ensures that the grip remains secure during use. The method 600 may be further modified consistent with the apparatuses described herein. The toggle button grip is pulled over the button on the toggle and may be rotated into a desired position comfortable to the user.

Figure 7A:
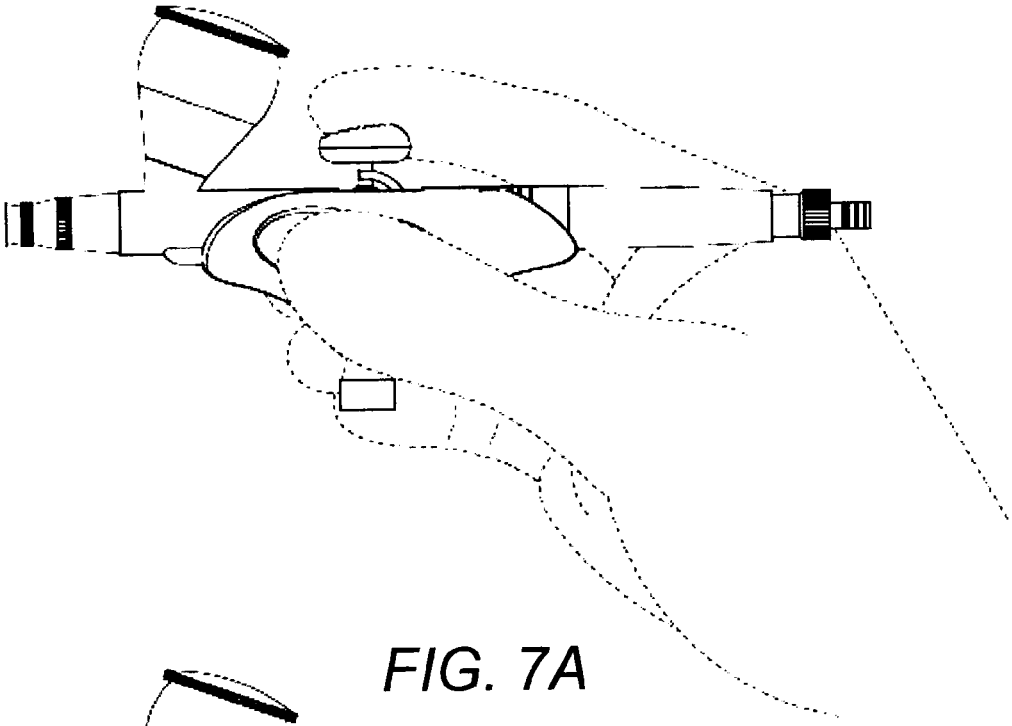
FIGS. 7A and 7B illustrate two variations of use of the exemplary pliant removable airbrush body and toggle grips.
Figure 7B:
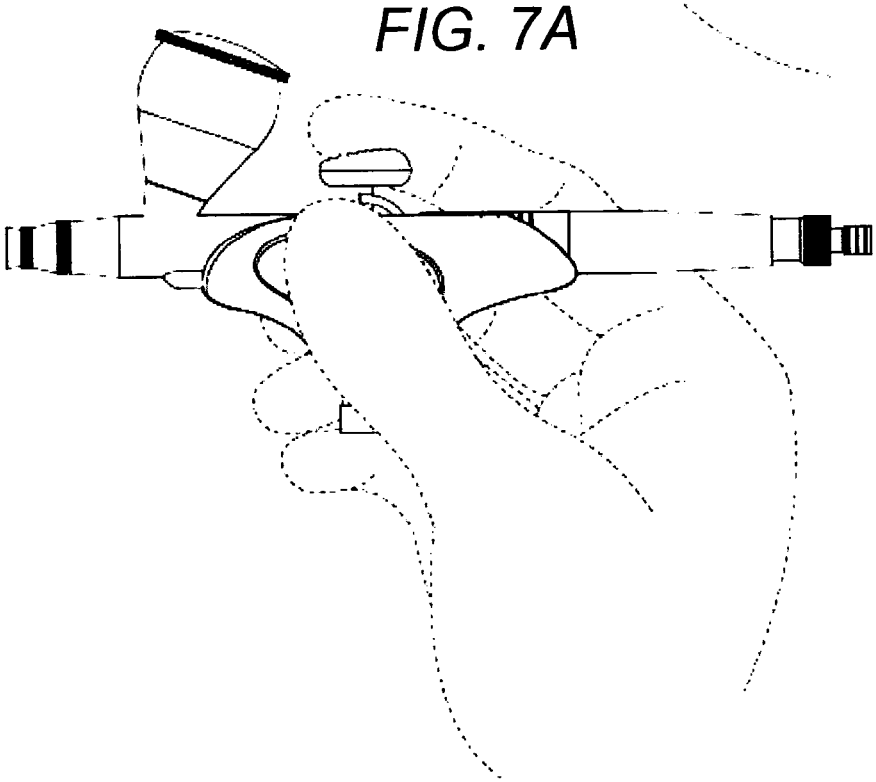

FIGS. 7A and 7B illustrate two variations of use of the exemplary pliant removable airbrush body and toggle grips. The grip of FIG. 7A employs a more open hand with the index finger held straighter and more parallel to the airbrush body. In contrast, the grip of FIG. 7B is tighter where the index finger wraps more around the barrel of the airbrush body. Using the different grips the thumb of the user can be positioned in one of the depressed regions. Thus, the body grip may accommodate the preferred grip of almost any user.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. An apparatus, comprising:

a pliant material piece having two ends defining a substantially cylindrical open passage therethrough such that the substantially cylindrical open passage includes an open axial seam; and a substantially cylindrical closed passage having two ends in the pliant material piece, where the substantially cylindrical closed passage intersects the substantially cylindrical open passage opposite the open axial seam;

wherein pliant material fills areas spanning between each of said ends of the substantially cylindrical open passage and the ends of the substantially cylindrical closed passage and the pliant material piece is configured to be applied to an airbrush such that the substantially cylindrical closed passage surrounds a stem of the airbrush and the substantially cylindrical open passage is around a cylindrical body of the airbrush and wherein the pliant material piece further comprises depressed regions on respective opposing exterior surfaces and the depressed regions each comprise a kidney bean shape having a front lobe and a rear lobe, wherein said front lobe is smaller than said rear lobe.

2. The apparatus of claim 1, wherein the substantially cylindrical open passage comprises a cylindrical surface larger than a half of a cylinder defining said cylindrical open passage.

3. The apparatus of claim 1, wherein the pliant material piece comprises silicone rubber.

4. The apparatus of claim 1, further comprising a second pliant material piece having a substantially disk shape, the substantially disk shape including a rough texture on a top side and a pocket on a bottom side;

wherein the second pliant material piece is configured to be applied to a toggle button of the airbrush such that the toggle button is enclosed by the pocket.

5. The apparatus of claim 4, wherein the second pliant material piece comprises silicone rubber.

6. A method of applying a grip to an airbrush, comprising the steps of:

providing a grip comprising a pliant material piece having two ends defining a substantially cylindrical open passage with an open axial seam, and a substantially cylindrical closed passage having two ends, said substantially cylindrical closed passage intersecting said substantially cylindrical open passage;

inserting a stem of the airbrush into said substantially cylindrical closed passage, where the substantially cylindrical closed passage intersects said substantially cylindrical open passage at a location opposite said open axial seam of the substantially cylindrical open passage, and pliant material fills areas spanning between each of said ends of the substantially cylindrical open passage and the ends of the substantially cylindrical closed passage, and wherein the pliant material piece further comprises depressed regions on respective opposing exterior surfaces and the depressed regions each comprise a kidney bean shape having a front lobe and a rear lobe, wherein said front lobe is smaller than said rear lobe;

drawing the pliant material piece onto the stem as the substantially cylindrical open passage is pulled over a cylindrical body of the airbrush at the open seam; and seating the open seam of the substantially cylindrical open passage around said cylindrical body.

7. The apparatus of claim 1, wherein the pliant material piece is configured such that the pliant material can accommodate a variety of different airbrushes and stretch in places to securely hold to most similar airbrush shapes across a range of airbrush sizes and features.

8. The method of claim 6, wherein the pliant material piece is configured such that the pliant material can accommodate a variety of different airbrushes and stretch in places to securely hold to most similar airbrush shapes across a range of airbrush sizes and features.

9. The apparatus of claim 4, wherein the rough texture of the second pliant material piece comprises a series of ridges.

10. The apparatus of claim 1, wherein the substantially cylindrical open passage comprises a cylindrical surface larger than a half of a cylinder defining said cylindrical open passage.

11. The method of claim 6, wherein the pliant material piece comprises silicone rubber.

12. The apparatus of claim 1, wherein the thumb of the user can be positioned in one of the depressed regions using different grips.

13. The method of claim 6, wherein the thumb of the user can be positioned in one of the depressed regions using different grips.

* * * * *